US010327564B1

(12) United States Patent
Schulman

(10) Patent No.: US 10,327,564 B1
(45) Date of Patent: Jun. 25, 2019

(54) MODULAR MATTRESS RENEWAL SYSTEM

(71) Applicant: Jared D. Schulman, Sandy Hook, CT (US)

(72) Inventor: Jared D. Schulman, Sandy Hook, CT (US)

(73) Assignee: Underpucks LLC, Sandy Hook, CT (US)

( * ) Notice: Subject to any disclaimer, the term of this patent is extended or adjusted under 35 U.S.C. 154(b) by 22 days.

(21) Appl. No.: 14/931,538

(22) Filed: Nov. 3, 2015

(51) Int. Cl.

| | |
|---|---|
| ***A47C 17/00*** | (2006.01) |
| ***A47C 27/14*** | (2006.01) |
| ***A47C 31/12*** | (2006.01) |
| *A47C 19/02* | (2006.01) |
| *A47C 21/06* | (2006.01) |
| *A47C 27/15* | (2006.01) |

(52) U.S. Cl.
CPC ..... *A47C 27/14* (2013.01); *A47C 31/123* (2013.01); *A47C 19/027* (2013.01); *A47C 21/06* (2013.01); *A47C 27/15* (2013.01)

(58) Field of Classification Search
CPC ..... A47C 27/14; A47C 31/123; A47C 27/146; A47C 27/144; A47C 27/15; A47C 27/16; A47C 27/20; A47C 19/205; A47C 19/027; A47C 21/06
See application file for complete search history.

(56) References Cited

U.S. PATENT DOCUMENTS

| | | | | | |
|---|---|---|---|---|---|
| 1,353,260 | A * | 9/1920 | Monks | A47C 23/047 | 5/655.3 |
| 2,434,641 | A * | 1/1948 | Burns | A47C 27/081 | 114/219 |
| 2,861,278 | A * | 11/1958 | Young | A47C 19/027 | 5/659 |
| 3,319,274 | A * | 5/1967 | Upton | A47C 27/144 | 428/182 |
| 3,605,145 | A * | 9/1971 | Graebe | A47C 27/081 | 297/DIG. 3 |
| 3,751,742 | A * | 8/1973 | Worley | A47C 19/027 | 5/659 |
| 4,005,236 | A * | 1/1977 | Graebe | A47C 27/081 | 428/178 |
| 4,815,155 | A * | 3/1989 | Sommers | A47C 21/06 | 5/417 |
| 4,852,195 | A * | 8/1989 | Schulman | A61G 7/05776 | 297/DIG. 8 |
| 4,878,258 | A * | 11/1989 | Casey | A47G 9/0207 | 160/368.1 |

(Continued)

*Primary Examiner* — Nicholas F Polito
*Assistant Examiner* — Morgan J McClure
(74) *Attorney, Agent, or Firm* — Edwin D. Schindler

(57) ABSTRACT

A modular mattress renewal system is disclosed. A support lattice is made up of a plurality of compressible nodal foam blocks connected one to the other by block connectors that fit into guide apertures within the nodal blocks. The connectors themselves are also compressible and flexible and the compressible nodal foam blocks are provided with an adhesive portion that allows the user to customize the support necessary. Additionally, the nodal foam blocks have varying degrees of compressibility and varying compressibility gradients and are marked as such to further enhance the support customization possible. Thus, sagging mattresses or mattresses with indentations from use over time may be rehabilitated.

20 Claims, 16 Drawing Sheets

(56) References Cited

U.S. PATENT DOCUMENTS 5,066,001 A * 11/1991 Wilkinson ..... A63B 6/00 482/52
5,152,023 A * 10/1992 Graebe ..... A47C 27/10 5/654
5,353,455 A * 10/1994 Loving ..... A47C 23/002 29/451
5,377,369 A * 1/1995 Shirai ..... A47C 20/04 5/188
5,448,789 A * 9/1995 Shirai ..... A47C 23/06 5/191
5,638,565 A * 6/1997 Pekar ..... A47C 4/54 5/653
5,640,731 A * 6/1997 Toedter ..... A47C 21/046 5/710
6,155,647 A * 12/2000 Albecker, III ..... A47C 1/146 297/228.12
6,308,354 B1 * 10/2001 Lilly ..... A47C 21/06 5/700
6,647,569 B1 * 11/2003 Tansek ..... A41D 31/005 2/413
6,763,611 B1 * 7/2004 Fusco ..... A43B 13/125 36/25 R
6,871,369 B1 * 3/2005 Long ..... A47C 21/06 5/655.9
7,036,162 B1 * 5/2006 Gatten ..... A47C 21/04 5/420
7,120,956 B1 * 10/2006 Liao ..... A47C 23/002 5/718
7,865,989 B2 * 1/2011 Steppat ..... A47C 27/144 5/719
9,038,221 B2 * 5/2015 Fraser ..... A61G 5/1043 5/654
9,241,578 B1 * 1/2016 Franken ..... A47C 21/06
9,265,354 B2 * 2/2016 Mason ..... A47C 27/146
9,510,690 B2 * 12/2016 Rawls-Meehan ..... A47C 7/14
9,561,396 B2 * 2/2017 Lazarchik ..... A63B 6/00
2005/0172412 A1 * 8/2005 Pearson ..... A47C 21/06 5/659
2006/0117486 A1 * 6/2006 Clark ..... A47C 21/06 5/659
2007/0000060 A1 * 1/2007 Firestone ..... A47C 27/081 5/659
2007/0088392 A1 * 4/2007 Skiba ..... A43B 1/0045 607/2
2007/0283496 A1 * 12/2007 Skripps ..... A61G 7/05784 5/654
2008/0034501 A1 * 2/2008 Hyde ..... A61F 5/05 5/613
2008/0078033 A1 * 4/2008 Wyatt ..... A47C 27/082 5/727
2009/0126107 A1 * 5/2009 Kuo ..... A47C 27/144 5/400
2010/0223730 A1 * 9/2010 Pearce ..... A47C 27/144 5/655.5
2011/0004998 A1 * 1/2011 Losio ..... A47C 23/002 5/699
2011/0041252 A1 * 2/2011 DeFranks ..... A47C 27/064 5/655.8
2011/0047707 A1 * 3/2011 Hobson ..... A47C 27/144 5/691
2016/0029810 A1 * 2/2016 Malkiewicz ..... A47C 27/20 5/724
2016/0286973 A1 * 10/2016 Quinn ..... A47C 27/002

* cited by examiner

MODULAR MATTRESS RENEWAL SYSTEM

BACKGROUND OF THE INVENTION

Field of the Invention

The present invention relates generally to beds and, more specifically, to a mattress enhancement that allows the user to compensate for the sags or indentations in the mattress that occur over a period of use. Even more specifically, it relates to a mattress enhancement that is modular and that additionally allows its use on various sized mattresses and on the portions thereof that require additional support for the comfort of the user. Even more specifically it relates to a modular mattress support that has varying degrees of compressibility in each of the support modules and that has fully modifiable connectors between the support modules for the varying ranges of support that are required in each specific case.

Description of the Prior Art

There are other support device designed for cushioning. Typical of these is U.S. Pat. No. 4,070,719 issued to Morgan on Jan. 31, 1978.

Another patent was issued to Fogel on Feb. 27, 2001 as U.S. Pat. No. 6,192,538. Yet another U.S. Pat. No. 6,401,282 was issued to Shum on Jun. 11, 2002 and still yet another was issued on Apr. 1, 2003 to Landvik et al. as U.S. Pat. No. 6,541,094.

Another patent was issued to Visser et al. on Oct. 11, 2005 as U.S. Pat. No. 6,952,850. Yet another U.S. Pat. No. 7,805,791 was issued to Malzl on Oct. 5, 2010. Another was issued to Gladney on Aug. 28, 2012 as U.S. Pat. No. 8,250,689 and still yet another was issued on Jan. 22, 2013 to Howard as U.S. Pat. No. 8,356,371.

Another patent was issued to Fukano on Feb. 12, 2013 as U.S. Pat. No. 8,370,979. Yet another U.S. Pat. No. 8,418,297 was issued to Mikkelsen et al. on Apr. 16, 2013. Another was issued to Witherell et al. on Oct. 22, 2013 as U.S. Pat. No. 8,613,120 and still yet another was issued on Dec. 24, 2013 to Hawkins as U.S. Pat. No. 8,613,120.

U.S. Pat. No. 4,070,719

Inventor: Charles W. Morgan

Issued: 31 Jan. 1978

An improved cushioning element is provided which is prepared from a synthetic resinous cellular resilient body. A plurality of intersecting grooves are formed in the surface of the cushioning element thereby providing a bodysupporting surface of a plurality of spaced-apart bosses generally independently deflectable and recoverable.

U.S. Pat. No. 6,192,538

Inventor: Isaac Fogel

Issued: 27 Feb. 2001

A mattress system offering combinations of comfort and support comprising at least two modules, positioned side-by-side along their longest dimension to define at least two recumbent user areas, and a comfort cushion receivable atop each of the at least two modules. At least one of the modules includes a depression in its upper surface, adapted to removably retain a support insert comprised of an envelope containing a plurality of liquid filled bladders. The mattress system provides an immense array of combinations of firmness and support, allowing each user to adjust, to a very wide degree, the comfort, firmness and support beneath their upper body, lumbar area, and lower body. The adaptable structure of the mattress system also allows the individual user to customize his/her side of the bed and easily change his/her side of the bed as his/her preferences change. Additionally, the construction increases the longevity of the bed, because components may be replaced one at a time as deemed necessary. Further, the various components of the modular mattress system enable the manufacturer to ship the bed at reduced cost to the customer, because the mattress system may be shipped in smaller freight components.

U.S. Pat. No. 6,401,282

Inventor: Hai S hum

Issued: 11 Jun. 2002

A mattress system, sofa, cushioned seat, and the like, having top surface made from rigid material which is divided into plurality of polygonal columns or spherical shapes and configured into a geometrical pattern in various size and shape which has the transversal width and the longitudinal length adding or reducing according to the user's preference. The top surface elements are correspondingly supported by plurality of resilient elements, which are pneumatic in general, adjustable to provide the preferable comfort, desirous top surface contour and prescriptive pressure at particular spots. The top surface elements and resilient elements are individually replaceable and exchangeable. The mattress, sofa, cushioned seat and the like can be retrofit or modified three dimensionally.

U.S. Pat. No. 6,541,094

Inventor: Dag Landvik et al

Issued: 1 Apr. 2003

A laminated support for pressure-relief comprising an upper layer of visco-elastic foam, a middle layer of visco-elastic foam having a greater hardness, and a bottom layer of highly resilient polyurethane foam. These layers are sandwiched between two layers of reticulated filter polyurethane foam.

U.S. Pat. No. 6,952,850

Inventor: Barnet D. Visser et al

Issued: 11 Oct. 2005

A no-flip mattress is constructed of a mattress core, a first padding layer positioned on top of the core, wherein the first padding layer has a density in the range from about 0.5 pounds per cubic foot to about 3 pounds per cubic foot and a firmness in the range from about 8 IFD to about 45 IFD. A second padding layer is adjacent to the first padding layer, wherein the second padding layer has a density in the range from about 0.5 pounds to about 1.9 pounds, and an IFD in the range from about 5 to about 23. A bottom support layer is beneath the core, and comprises a relatively dense and firm material.

U.S. Pat. No. 7,805,791

Inventor: Hans L. Malzl

Issued: 5 Oct. 2010

The invention relates to a sectional element mat (2), the support properties of which may be individually tailored, whereby exchangeable sectional elements (E) are arranged tightly together or above each other. The above is characterized in that the individual sectional elements (E) may be easily removed and exchanged with other sectional elements. The individual sectional elements are either connected to each other by means of a separable material bridge or perforation (5, 6), connected to each other by means of a plug connector (27, 31), plugged onto or into a common base mat (40) or lying loose on the same. Individual sectional elements can be removed or separated from the combination where necessary and replaced by softer or stiffer sectional elements. In certain situations the resulting free space is left empty. The sectional element mat (2) is either part of a combination with other sectional element mats or contiguous or separate layers (1, 3), or itself forms the mattress core.

U.S. Pat. No. 8,250,689

Inventor: Richard F. Gladney

Issued: 28 Aug. 2012

The support characteristics within a foam mattress body may be varied by inserting reinforcements into channels cut or otherwise formed within the foam.

U.S. Pat. No. 8,356,371

Inventor: John H. Howard

Issued: 22 Jan. 2013

A mattress system and method according to which a custom mattress is built according to customer-specific parameters. In several exemplary embodiments, the custom mattress includes one or more removable core cartridges and/or one or more removable topper cartridges . . . .

U.S. Pat. No. 8,370,979

Inventor: Michihiro Fukano

Issued: 12 Feb. 2013

Provided is a mattress wherein the elastic characteristics of each portion can be changed simply and inexpensively depending on the user's preference. A mattress (10) has a plurality of spring units (60, 70, 80, 90) respectively constituted by holding a plurality of vertically stretchable pocket coils integrally, a lower elastic body (40) in which a housing space (44) capable of housing and holding the spring units (60, 70, 80, 90) is formed, and an upper enclosure (21) and a lower enclosure (30) for covering the outer periphery of the lower elastic body (40), wherein the lower elastic body (40) is provided with a partitioning elastic body (50) for dividing the housing space (44) into a plurality of spaces, and the spring units (60, 70, 80, 90) are formed in such a shape that each of the spring units can be housed in the divided housing spaces (44), and are housed and held in the respective divided housing spaces (44).

U.S. Pat. No. 8,418,297

Inventor: Tom D. Mikkelsen

Issued: 16 Apr. 2013

A support cushion including a top surface, a bottom surface opposite top surface, a layer of flexible foam having plurality of cells defining a reticulated cellular structure, the reticulated cellular structure cells comprising a skeletal plurality of supports through which substantially open cell walls establish fluid communication between interior of the cell and interiors of adjacent cells, the layer of flexible foam having density no less than about 30 kg/m.sup.3 and no greater than about 175 kg/m.sup.3, and hardness of no less than about 20 N and no greater than about 150 N at 40% indentation force deflection measured at about 22 degrees Celsius, the layer of flexible foam comprising visco-elastic foam having at least one material property responsive to temperature change in range of 10-30.degree. C., and layer of polyurethane foam located beneath layer of flexible foam, the layer of polyurethane foam having hardness of at least about 50 N.

U.S. Pat. No. 8,561,236

Inventor: Timothy M. Witherell et al

Issued: 22 Oct. 2013

Stepped-edge and side-support members, systems, assemblies, and related methods for an innerspring assembly or other core are disclosed. In one embodiment, an innerspring assembly or core is provided having an interior area of a first height surrounded by one or more exterior, perimeter area(s) of shorter height(s) to provide a stepped-edge innerspring assembly or core. At least a portion of side-support members are placed onto at least a portion of the top surface of the perimeter area to provide edge-support for the innerspring assembly or core. In this manner, a greater portion of the side-support members can be disposed in the sleeping area of the innerspring assembly or core since the underlying perimeter area provides spring support to the side-support members. Further, this support can assist in retention and/or recovery of the shape of the side-support members to further prevent or reduce compression set of the side-support members.

U.S. Pat. No. 8,613,120

Inventor: Steven D. Hawkins

Issued: 24 Dec. 2013

A cushioning device with an upper foam layer and a lower positioned foam layer, with the upper foam layer having multiple thickness zones defined by different height projections from one zone to another as to provide a thickness variation pattern, one side of the upper foam layer is less contoured when not yet assembled in the cushioning device and a second side is comprised of the multiple thickness zones such that, upon connection of the multiple thickness zones to the lower positioned foam layer, the height differential along a length of the upper foam layer is transmitted as to form a non-planar, crown configuration in the upper surface of the upper foam layer. A method includes roller contouring different height and shaped projection zones including zones with different ratios of peak height to overall zone height.

While these various devices may be suitable for the purposes for which they where designed, they would not be as suitable for the purposes of the present invention as heretofore described. It is thus desirable to provide a modular mattress support that is fully customizable by the user. It is further desirable to provide a modular mattress support where the connectors between the support units are flexible, or semi-flexible to allow for various configurations of the support units to be placed as needed between the mattress and the box spring or other base support.

SUMMARY OF THE PRESENT INVENTION

A primary object of the present invention is to provide a modular renewal system for an existing mattress.

Another object of the present invention is to provide a modular renewal system for an existing mattress where the interlocking support system is variously configurable to allow the system to be used on a variety of mattress sizes.

Yet another object of the present invention is to provide a modular renewal system for a mattress where the nodal blocks of the system may be made up of a variety of layers with varying compressibility, depending on the degree of support that needs to be added to the mattress.

Still yet another object of the present invention is to provide a modular renewal system for a mattress where the layering of the nodal blocks may be a single layer with an increasing density to provide a support gradient between the box spring and the mattress itself.

Another object of the present invention is to provide a modular renewal system for a mattress where the nodal block connectors extending between the necessary blocks are flexible to allow for user customization.

Yet another object of the present invention is to provide a modular renewal system where the layers or gradients in the nodal blocks provide a shock absorbing means.

Still yet another object of the present invention is to provide a modular renewal system for a mattress where the system itself is not detectable by the user once it has been put in place.

Still yet another object of the present invention is to provide a modular renewal system for mattresses or the like where the varying degrees of compressibility in the nodal blocks are color coded for ease in customization.

Additional objects of the present invention will appear as the description proceeds.

The present invention overcomes the shortcomings of the prior art by providing a fully customizable modular mattress renewal system that allows the user to compensate for the sleep indentations in the mattress that appear over time.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

DESCRIPTION OF THE REFERENCED NUMERALS

Turning now descriptively to the drawings, in which similar reference characters denote similar elements throughout the several views, the figures illustrate the use of the present invention. With regard to the reference numerals used, the following numbering is used throughout the various drawing figures.

10 present invention
12 nodal foam blocks
14 nodal block connectors
16 nodal block contoured guide apertures
18 single compressive layer nodal block
20 double compressive layer nodal block
22 triple compressive layer nodal block
24 adhesive base layer
26 mattress
28 box spring
30 mattress sleep indentations
32 sofa
34 bed
36 easy chair
38 block connector engagement ends
40 single foam layer
42, 42A double foam layer
44, 44A, 44B triple foam layer
46 support arrows
48 king-size box spring
50 king-size mattress
52 compressed nodal foam block
54 star guide aperture
56 square guide aperture
58 star guide connector end
60 square guide connector end
62 diamond-shaped connector end
64 diamond guide aperture
66 cross-shaped connector end
68 cross-shaped aperture
70 round connector end
72 round receiving aperture
74 hexagonal connector end
76 hexagonal receiving aperture

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
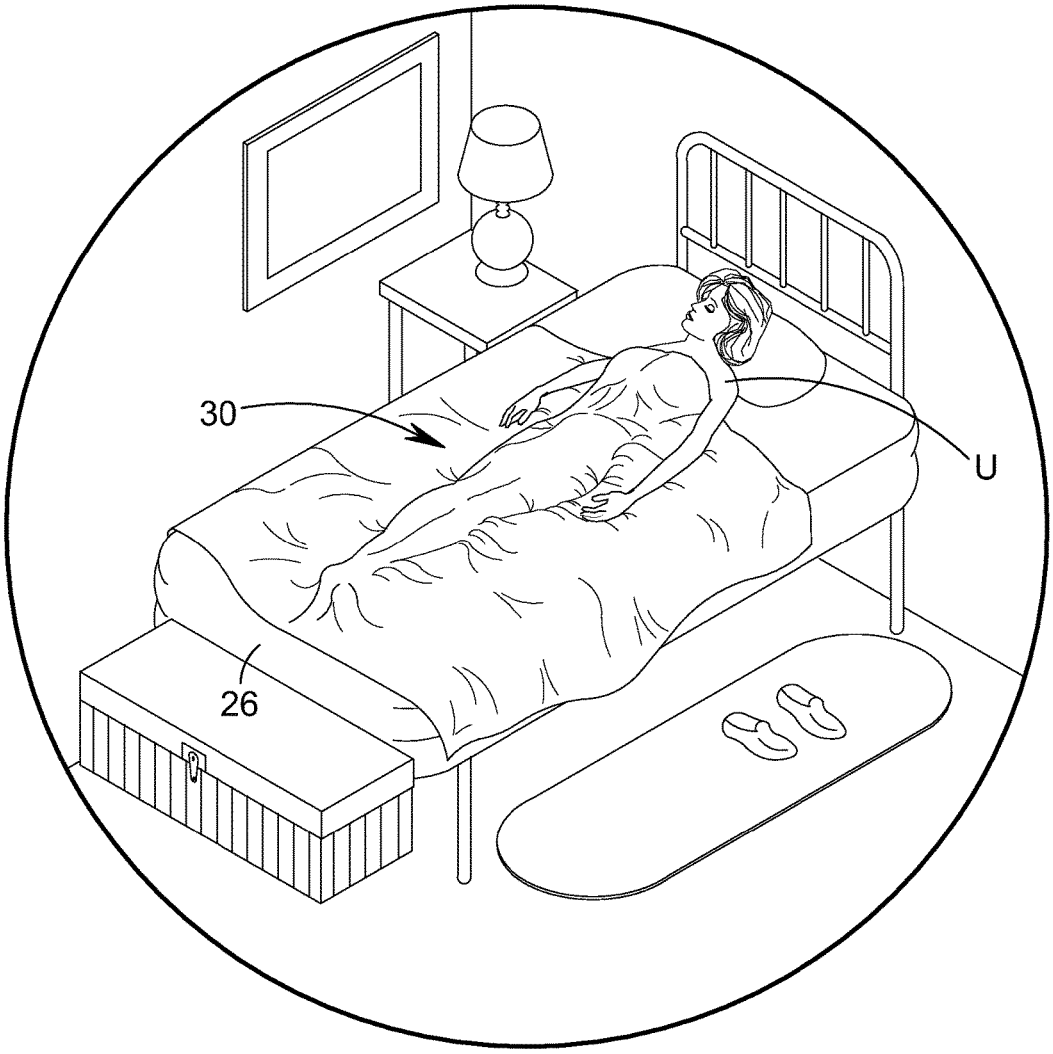
PRIOR ART FIG. 1
FIG. 1 is an illustrative view of the prior art.

Turning first to FIG. 1, a view of the prior art is seen. Over the course of time a user U sleeping in a regular position on a mattress 26 causes a sleep indentation as indicated at 30. These sleep indentations 30 are annoying in that they may cause back problems as they become more pronounced and that they can lead to disturbed sleep. In many cases, makeshift solutions, such as boards or folded blankets located under the mattress are used, but these types of solutions are ineffective, difficult to fit, and can be felt by the user. Additionally, these makeshift solutions may cause more problems than they solve, by making portions of the mattress unaffected by the sleep indentations 30 too firm for the user's comfort.

Figure 2:
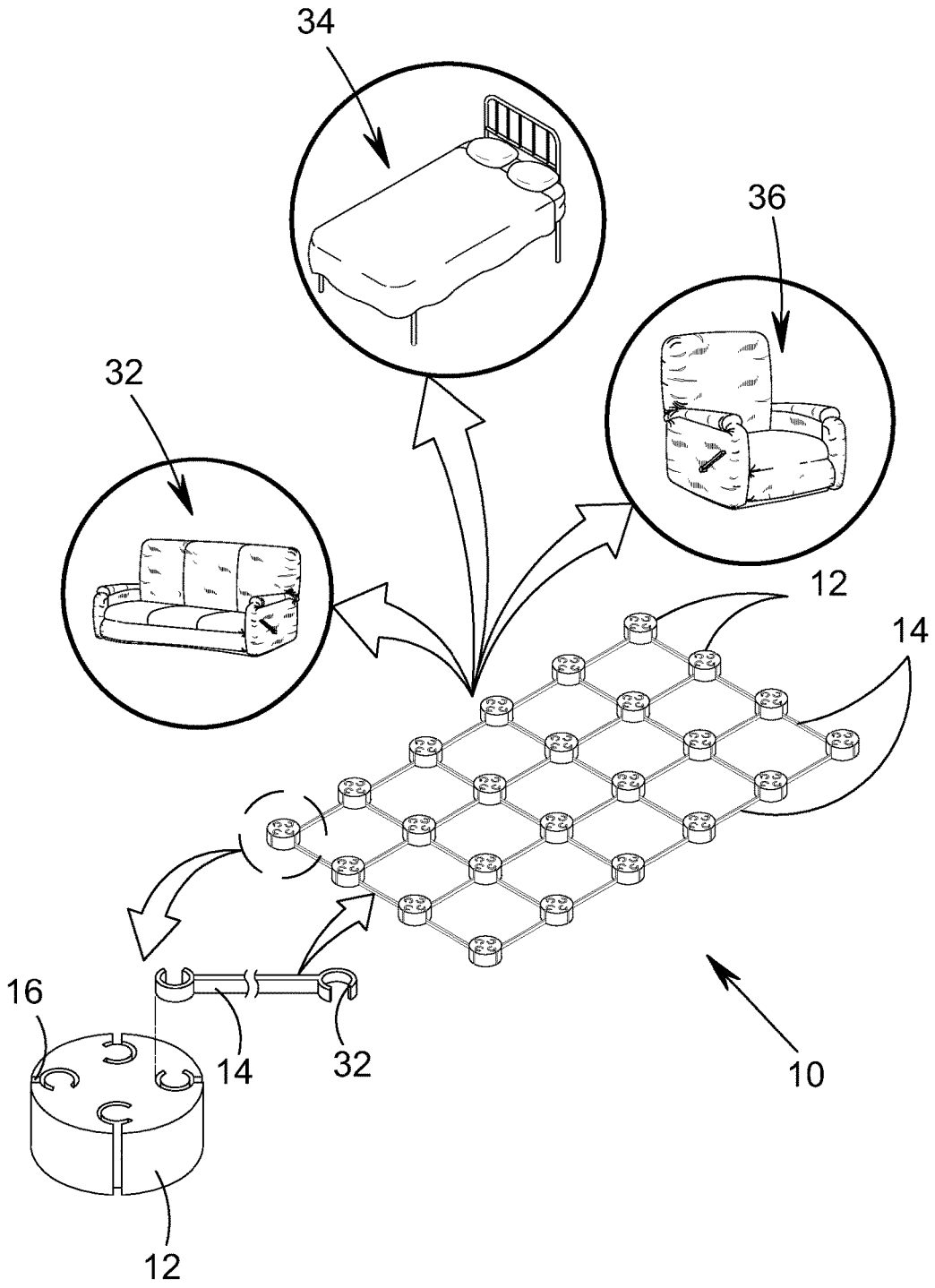
FIG. 2 is an illustrative view of the present invention and its uses.

FIG. 2 shows the present invention, indicated at 10. The invention 10 includes a plurality of nodal foam blocks 12 attached one to the other by a plurality of nodal block connectors 14. As can be seen and as will be discussed further below, each of the nodal foam blocks includes contoured guide apertures 16 which are selectively engageable with nodal block connector engagement ends indicated at 38. The present invention 10 relieves the sagging that occurs over time in cushions, mattresses, and the like and as is seen in the Figure, the present invention 10 may be used to increase the comfort of an easy chair 36, a bed 34, or a sofa 32. Other types of furniture with cushions, could of course, also be addressed.

Figure 3A:
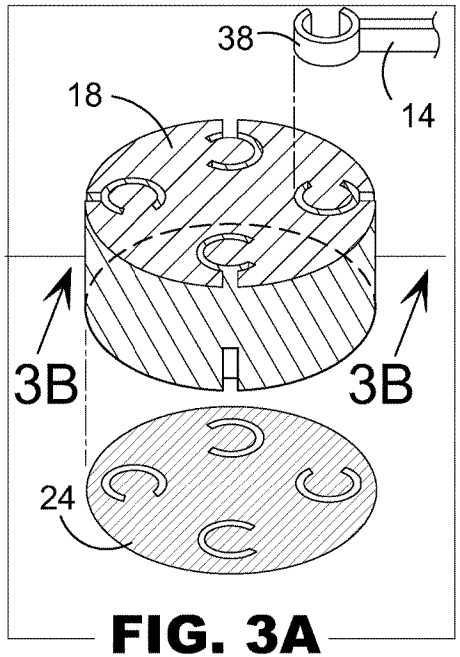
FIG. 3A is an illustrative view of a single density nodal foam block.
Figure 3C:
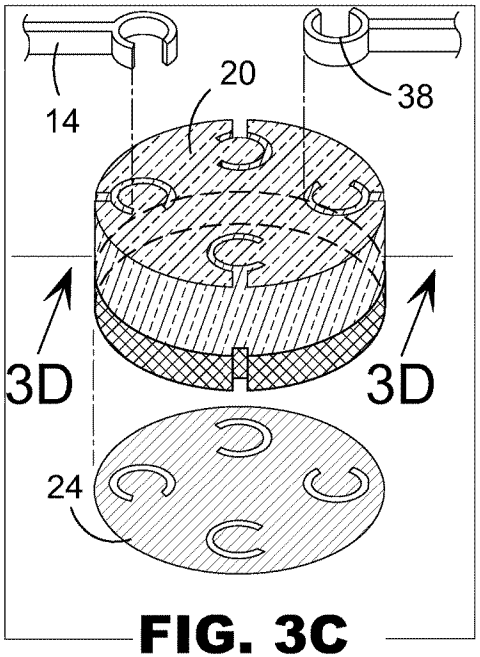
FIG. 3C is an illustrative view of a multi layered nodal foam block having differing densities.
Figure 3E:
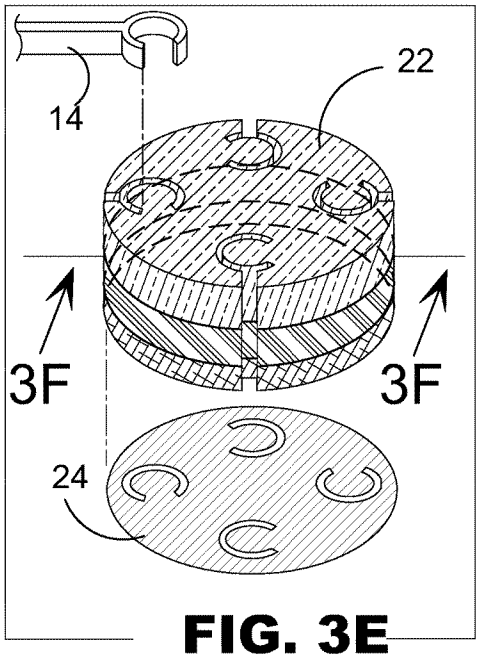
FIG. 3E is an illustrative view of a nodal foam block having a plurality of layers having differing densities.
Figure 3B:
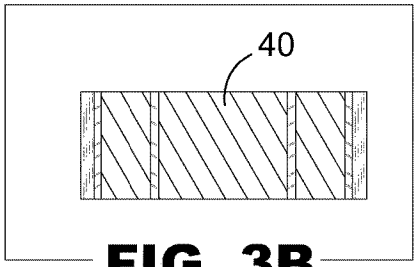
FIG. 3B is a cross sectional view of the single density nodal foam block, taken from FIG. 3A as indicated.
Figure 3D:
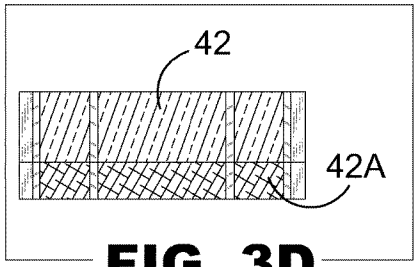
FIG. 3D is a cross sectional view of the multi layered nodal foam block, taken from FIG. 3C as indicated.
Figure 3F:
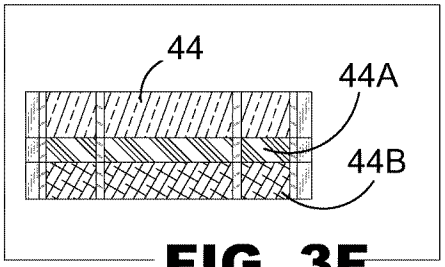
FIG. 3F is a cross sectional view of the plural layered nodal foam block, taken from FIG. 3E as indicated.

Turning now to FIGS. 3A to 3F, various types of foam construction involved in the nodal blocks 12 will be discussed. First in FIG. 3A a single layer of foam construction is shown and is indicated at 18. In FIG. 3B this single layer is indicated at 40. This layer 40 could include a density gradient from the bottom of the block proximate the adhesive base layer 24 to the top, or it could be consistent all the way through. In FIG. 3C a double layer of foam having different compressibility and densities is indicated generally at 20 and these layers are pointed out in FIG. 3D at 42 and 42A. Likewise the adhesive base layer 24 is also seen. In FIG. 3E a triple layer of foam having different compressibility and densities is generally indicated at 22 and these layers are more specifically indicated in FIG. 3F at 44, 44A, and 44B. The various nodal foam blocks 12 (and the variations seen in this Figure at 18, 20, and 22) can be chosen by the user to provide the amount of support that is desired. It is contemplated that the varying compressibility combinations of these blocks 12 could be color coded to aid in the in-place assembly of the invention. Another aspect of the present invention is that either the density gradient of the blocks 12 as seen in the Figures or the layers of the blocks as indicated at 18, 20, and 22 allows for lateral or torsional movement of the upper portion of the blocks 12 (proximate the mattress) to prevent detection and sliding or the like, which provides additional comfort for the user once the present invention 10 is in place.

Figure 4:
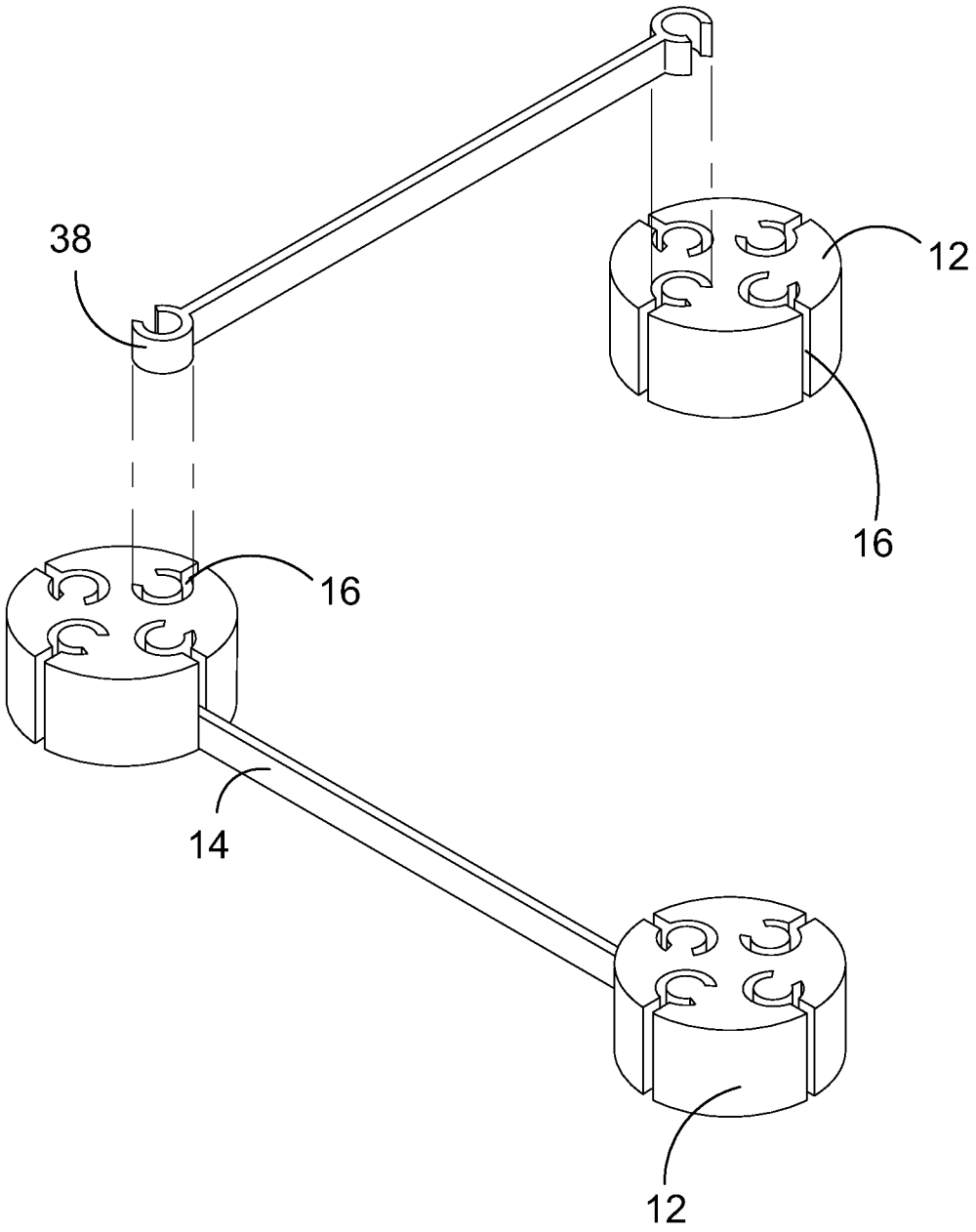
FIG. 4 is an illustrative view of the nodal foam blocks and the block connectors.

Turning now to FIG. 4 the details of the connectors 14 will be discussed. As can be seen in the Figure, the blocks 12 are provided with a plurality of contoured guide apertures as indicated at 16. In this Figure these are seen as half-moon shaped slots extending substantially through the nodal foam blocks 12. The connectors 14 themselves are contemplated as being made of a flexible and compressible material, similar to that of the compressed nodal blocks 12 themselves. The flexibility of the block connectors 14 allow for even greater customization of the invention 10 as it is being installed. Also as discussed above, the flexibility and compressibility of the connectors 14 additionally add to the comfort of the device during use in that the user will be unaware of the present invention's presence below the mattress. It should be noted here that various types of mattresses will benefit from the application of the present invention such as inner spring mattresses, pillowtop mattresses, and the like.

Figure 5:
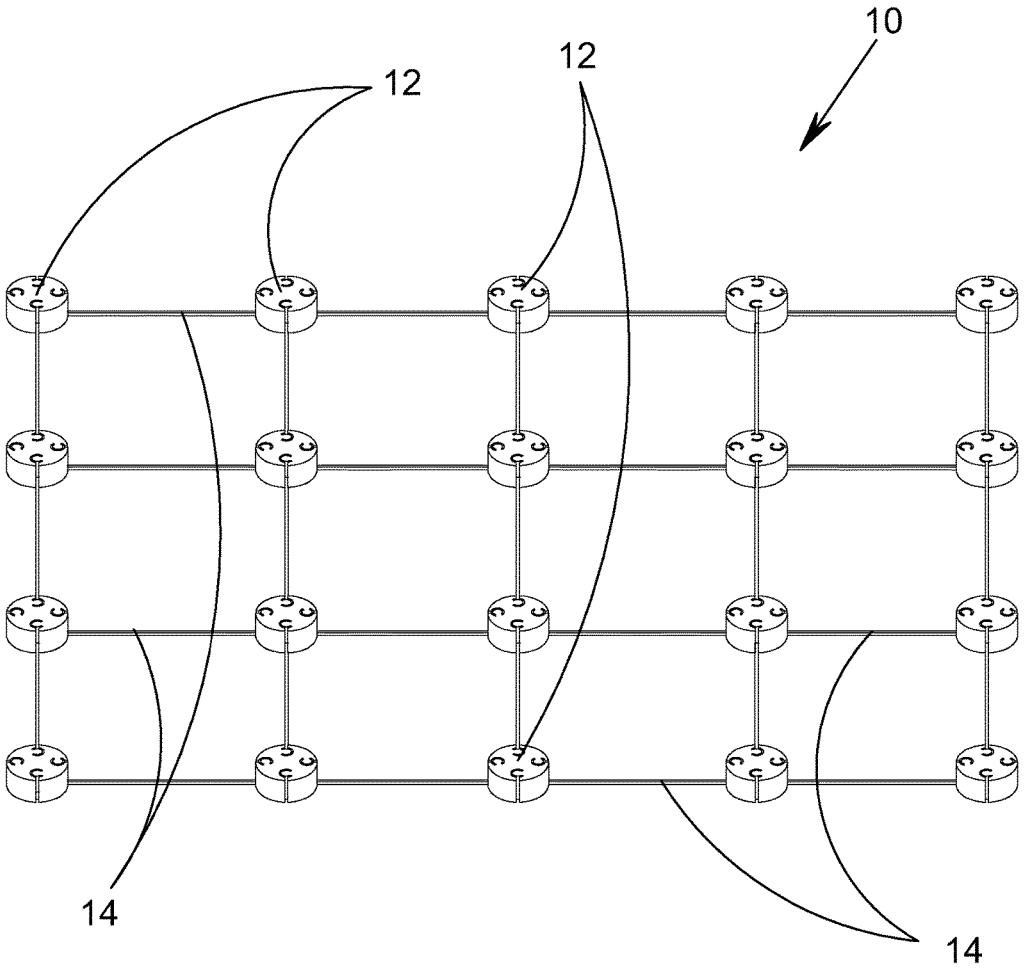
FIG. 5 is a perspective view of one embodiment of the present invention with the block connectors latched to form a support between a box spring and the mattress.

FIG. 5 shows an assembled lattice array of the present invention 10 with the nodal foam blocks 12 and the block connectors 14 attached to one another to form an array that is to be placed under the sagging or weakened portion of the mattress, cushion, or the like.

Figure 6:
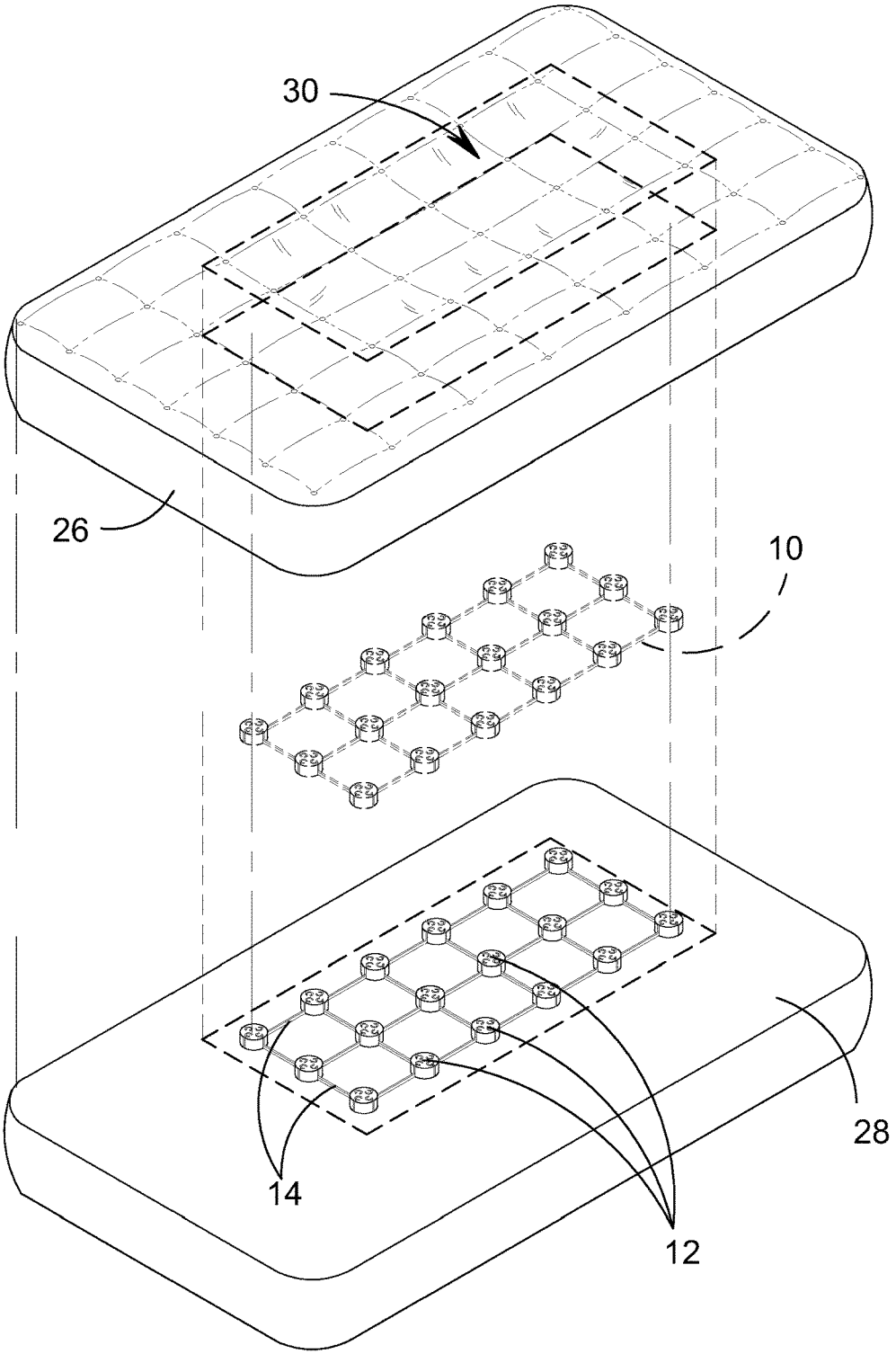
FIG. 6 is an exploded view of an embodiment of the present invention in use between a box spring and a mattress.

The exploded view seen in FIG. 6 shows the present invention 10 ready to be placed as shown between the box spring 28 and the mattress 26 to solve the problem of the mattress sleep indentation indicated at 30. The present invention may be easily assembled and placed as needed.

Figure 7:
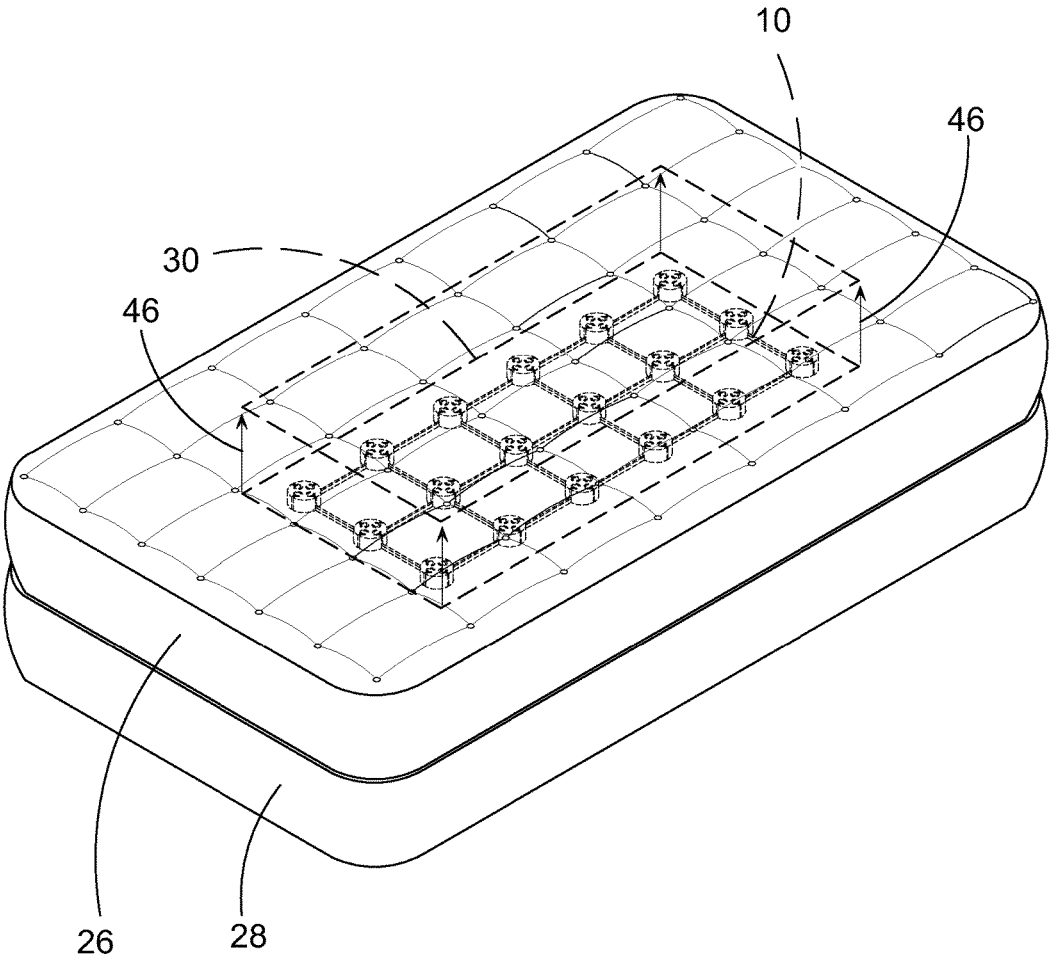
FIG. 7 is a view showing an embodiment of the present invention assembled in place between the box spring and the mattress.

In FIG. 7 the present invention 10 is shown in place between the mattress 26 and the box spring 28. The present invention eliminates the sleep indentation 30 as is indicated by the support arrows 46. One of the advantages of the present invention 10 is that no further adjustment is necessary once it is in place such as is needed with inflatable air bladders or the like.

Figure 8:
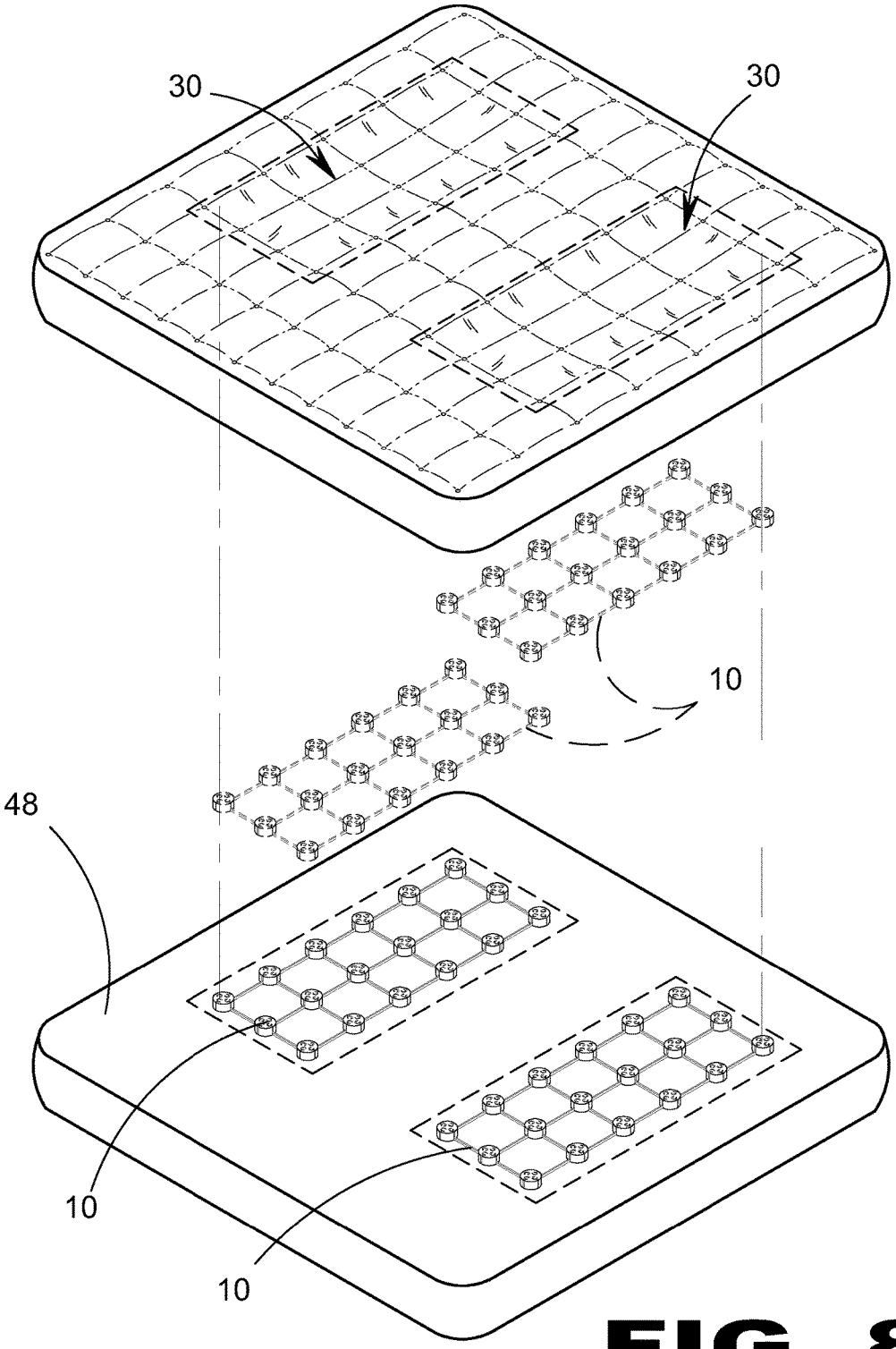
FIG. 8 is an exploded view of an embodiment of the present invention being used on a king-sized mattress with two sleep indentations.

Referring to FIG. 8 the present invention is shown being installed under a king-size mattress 50 and above the king-size box spring 48. The invention 10 is located beneath each of the mattress sleep indentations 30.

Figure 9:
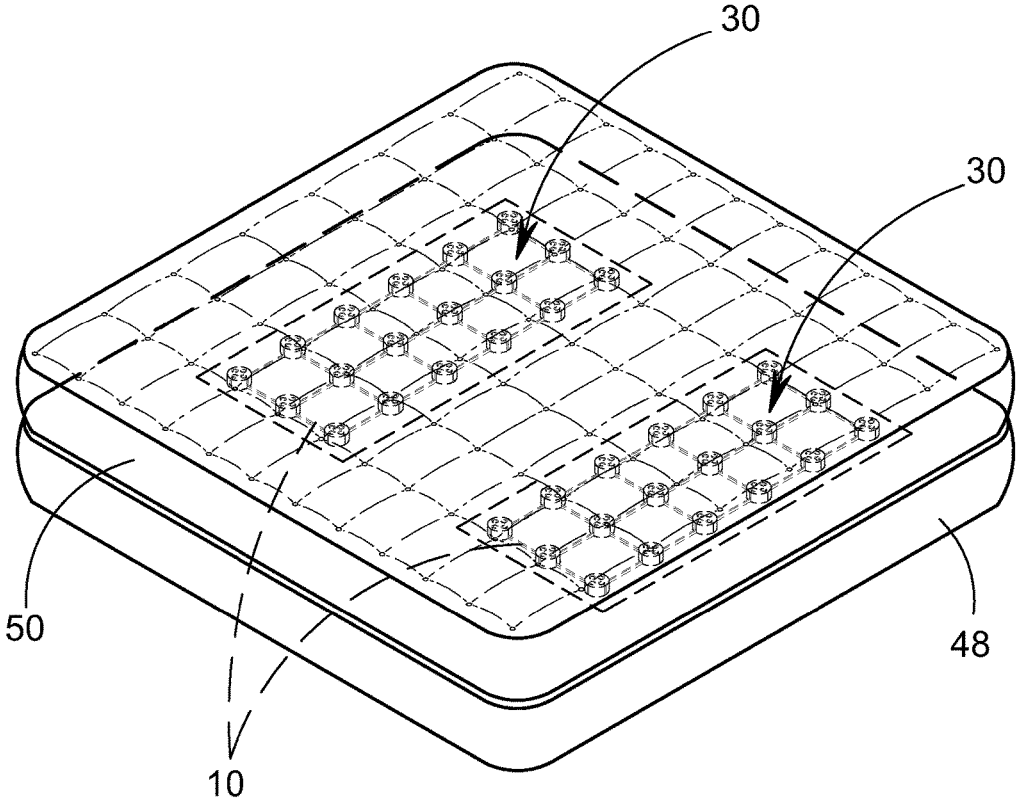
FIG. 9 is an assembled view of the present invention in a king-sized mattress, related to that seen in FIG. 8.

FIG. 9 shows the present invention 10 in place between the king-size box spring 48 and the king-size mattress 50 and supporting the two mattress sleeping indentations as indicated at 30.

Figure 10:
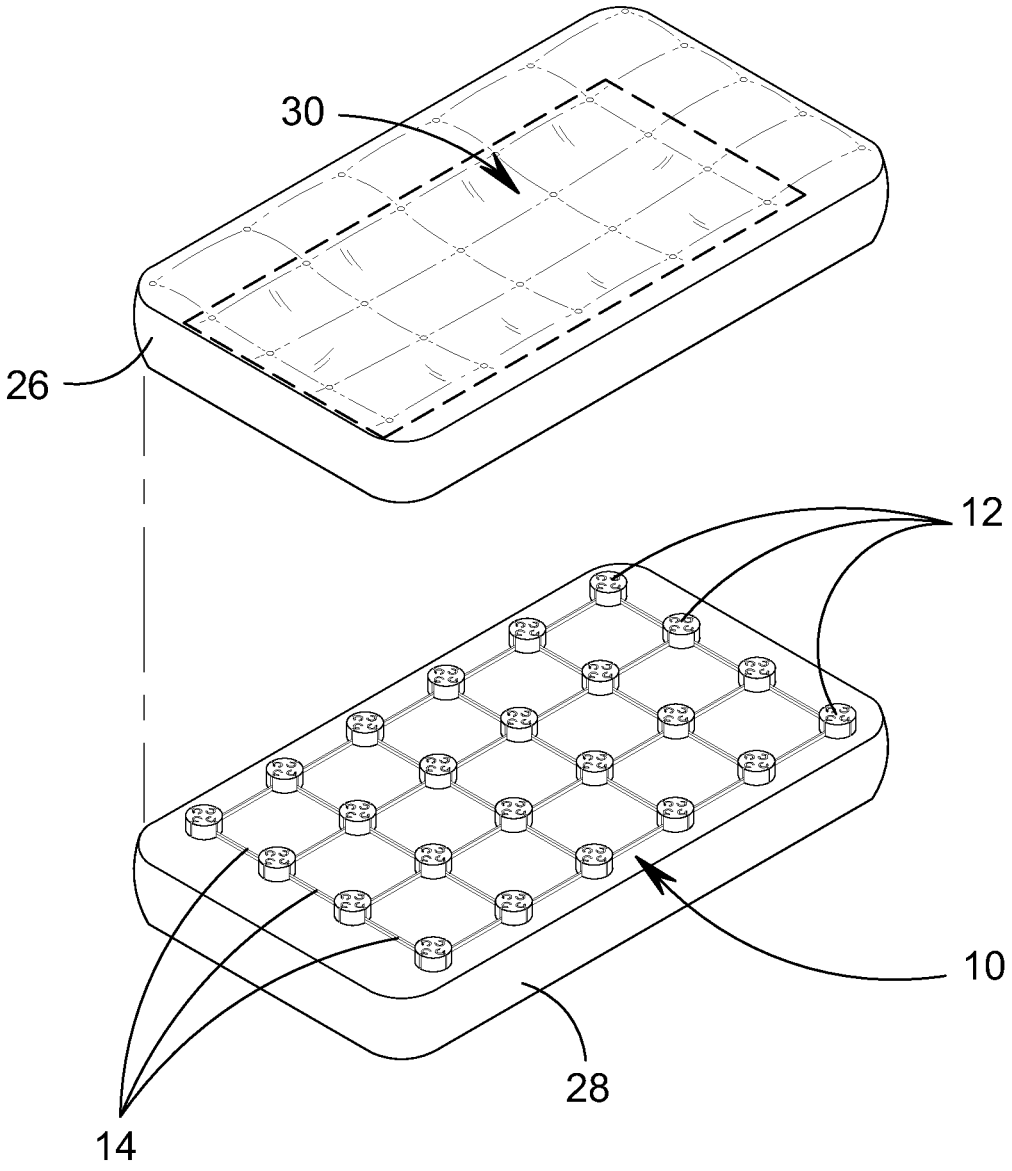
FIG. 10 is an illustrative view of the present invention in use.

FIG. 10 shows the present invention 10 assembled and placed between the mattress 26 and box spring 28 with the nodal foam blocks 12 and the connectors 14 spread in an array that is designed to support the mattress sleep indentation 30.

Figure 11:
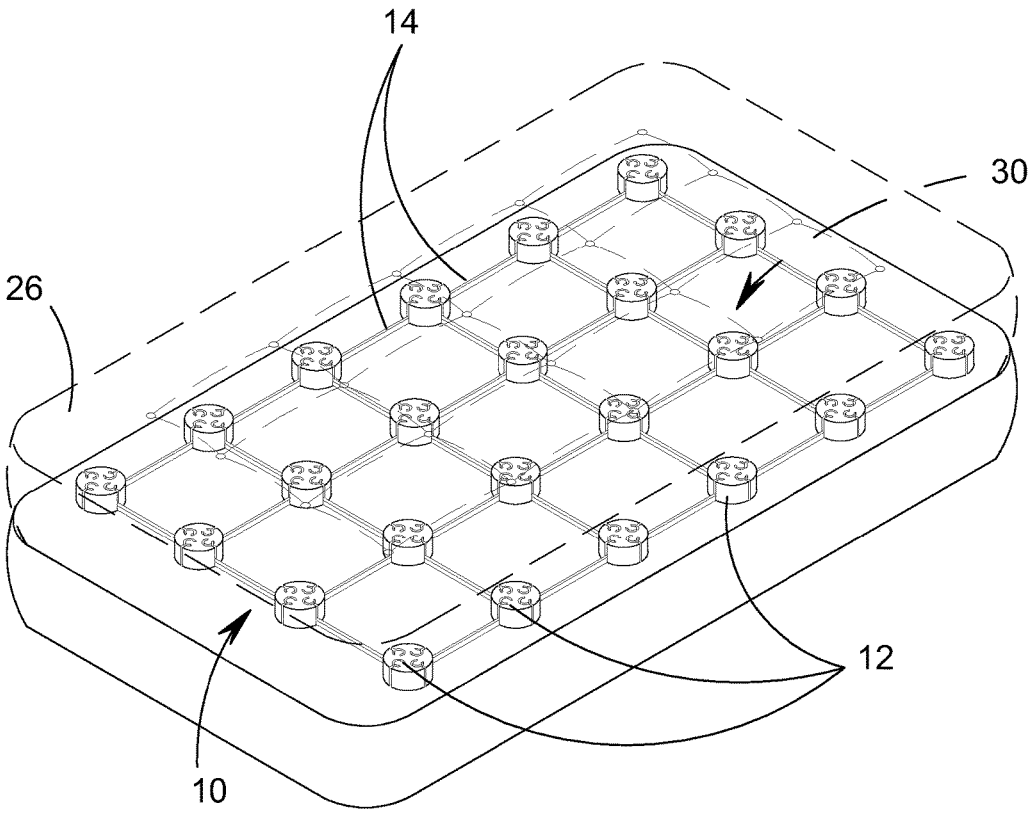
FIG. 11 is another assembled view of the present invention in use.

In FIG. 11 the present invention 10 is seen in place between the mattress 26 and the box spring 28 with the nodal foam blocks 12 and the corresponding connectors 14 forming a support lattice underneath the mattress sleep indentation 30.

Figure 12:
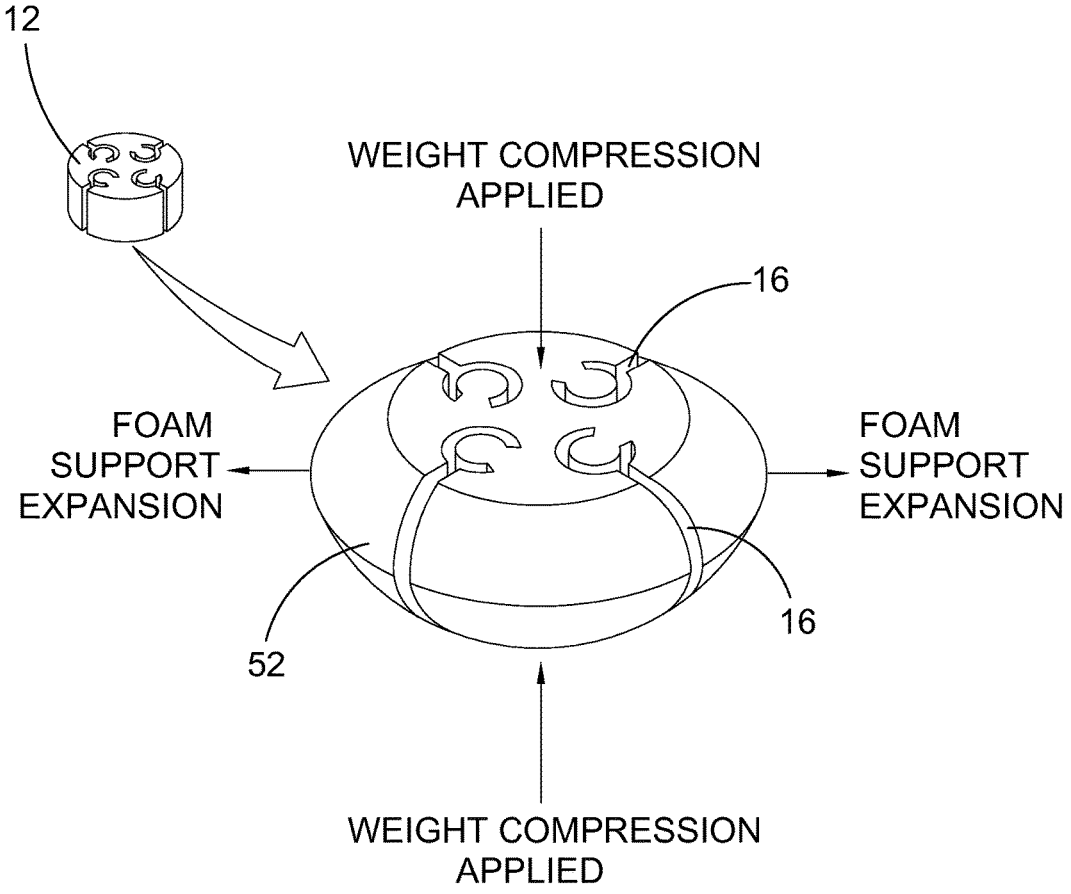
FIG. 12 is a perspective view of one of the nodal foam blocks under pressure.

FIG. 12 shows first the uncompressed nodal foam block 12 as is seen in the other Figures discussed above. Additionally, the Figure shows the compressed nodal foam block as indicated at 52 and the contoured guide apertures 16 adapted to receive the block connector engagement ends 38 of the block connectors 14 (neither seen in this Figure) as the compressed nodal block 52 stabilizes the mattress.

Figure 13:
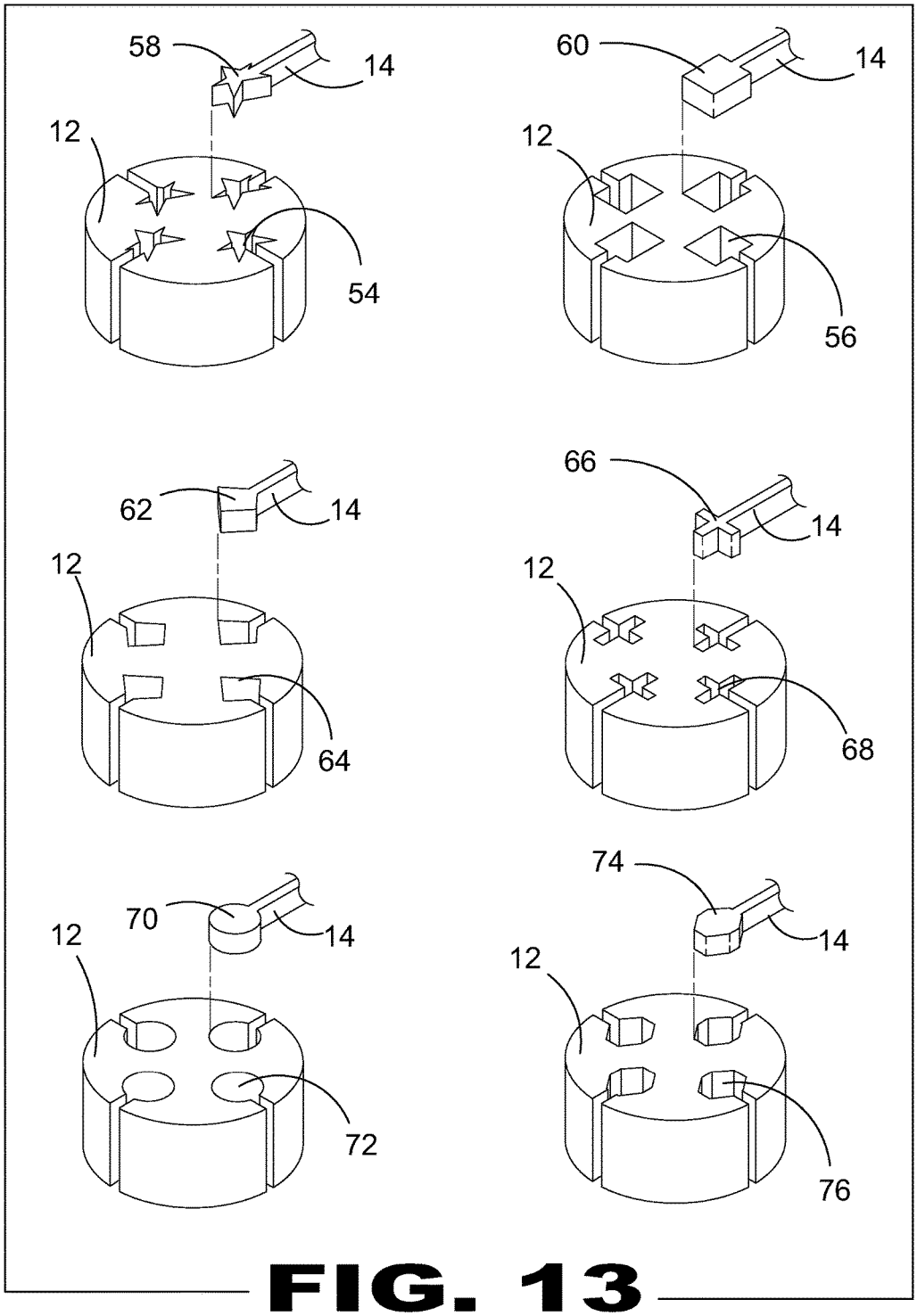
FIG. 13 is an illustrative view of various configurations and contoured shapes for attachment of the nodal blocks and the various block connectors.

Turning to FIG. 13 various ends are disclosed for the block connectors indicated throughout the Figure at 14. First we see a star-shaped connector end at 58 with the corresponding star guide aperture 54. A square shaped connector end 60 has a square guide aperture 56. The diamond-shaped connector end 62 is fitted to a diamond-shaped receiving aperture 64, a cross-shaped connector end 66 is fitted to a cross-shaped receiving aperture 68, a round connector end 70 fits into a round receiving aperture 72 and, likewise, a hexagonal connector end 74 fits a hexagonal receiving aperture 76. It should be understood that any shape of connector ends and corresponding receiving apertures could be utilized in the performance of the present invention and these connector ends and receiving apertures are in no way limited to those seen in the Figures. As long as the present invention 10 is supported and stable in creating the lattice needed under the mattress the connecting shapes do not signify except that they provide a secure stable structure.

Figure 14A:
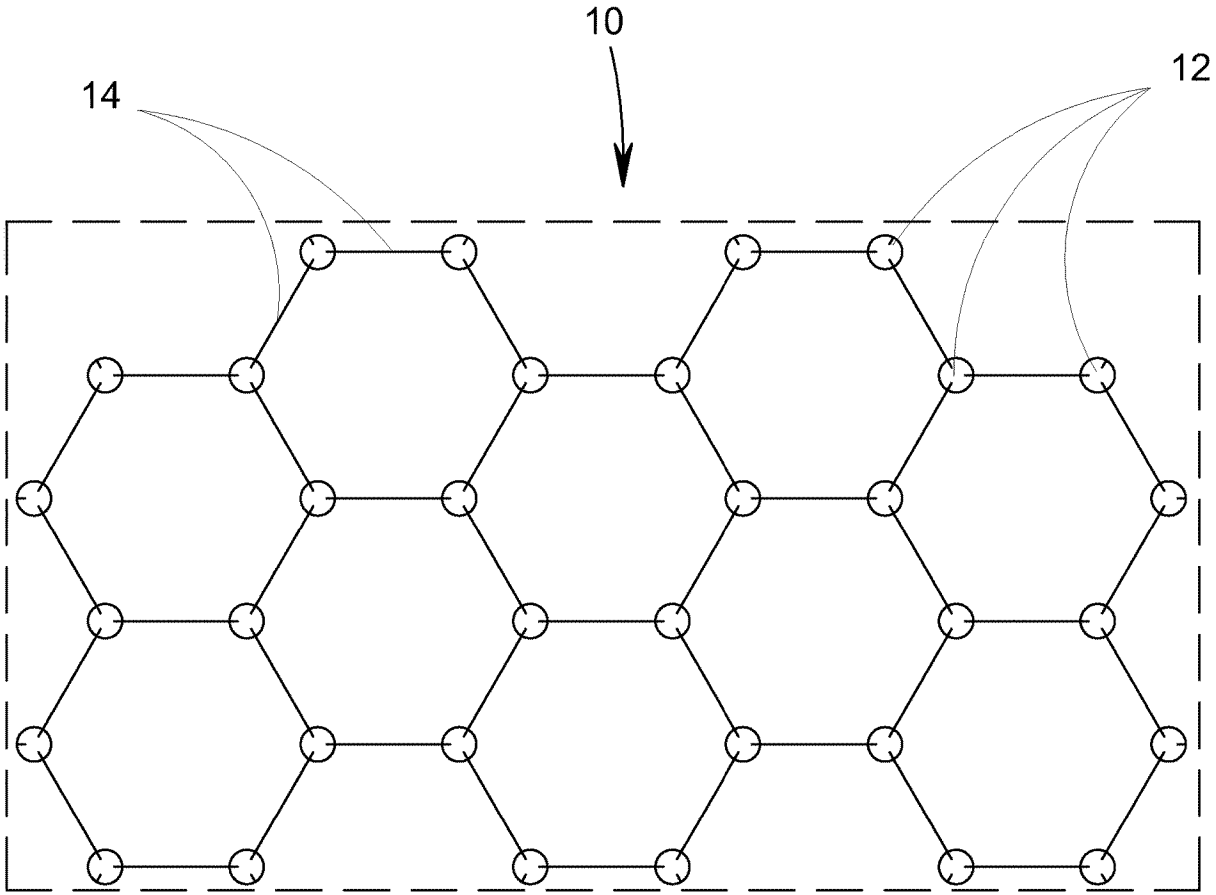
FIG. 14A is an illustrative view of the nodal blocks and the corresponding block connectors in a hexagonal configuration.
Figure 14B:
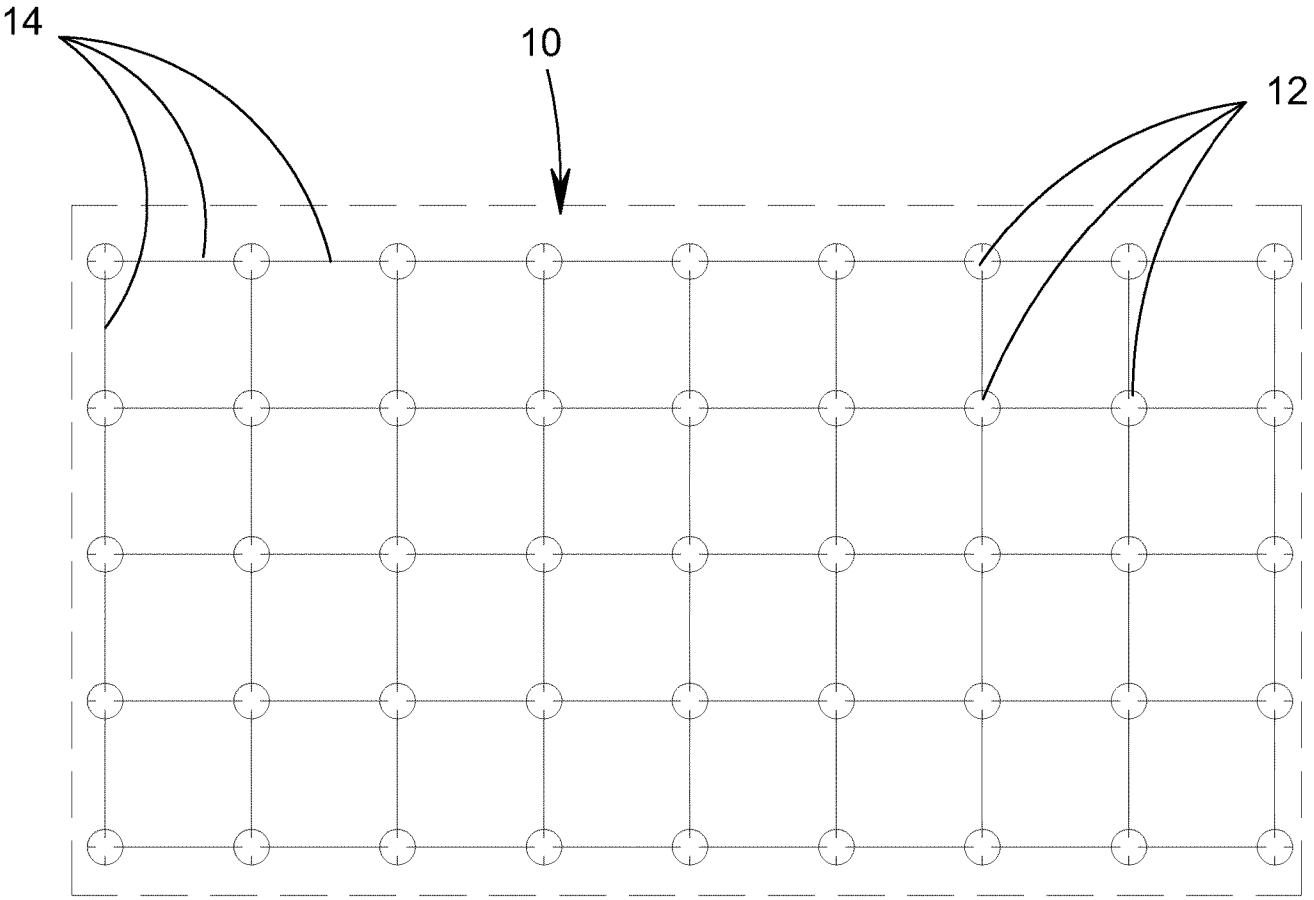
FIG. 14B is an illustrative view of the nodal blocks and the corresponding block connectors in a square configuration.
Figure 14C:
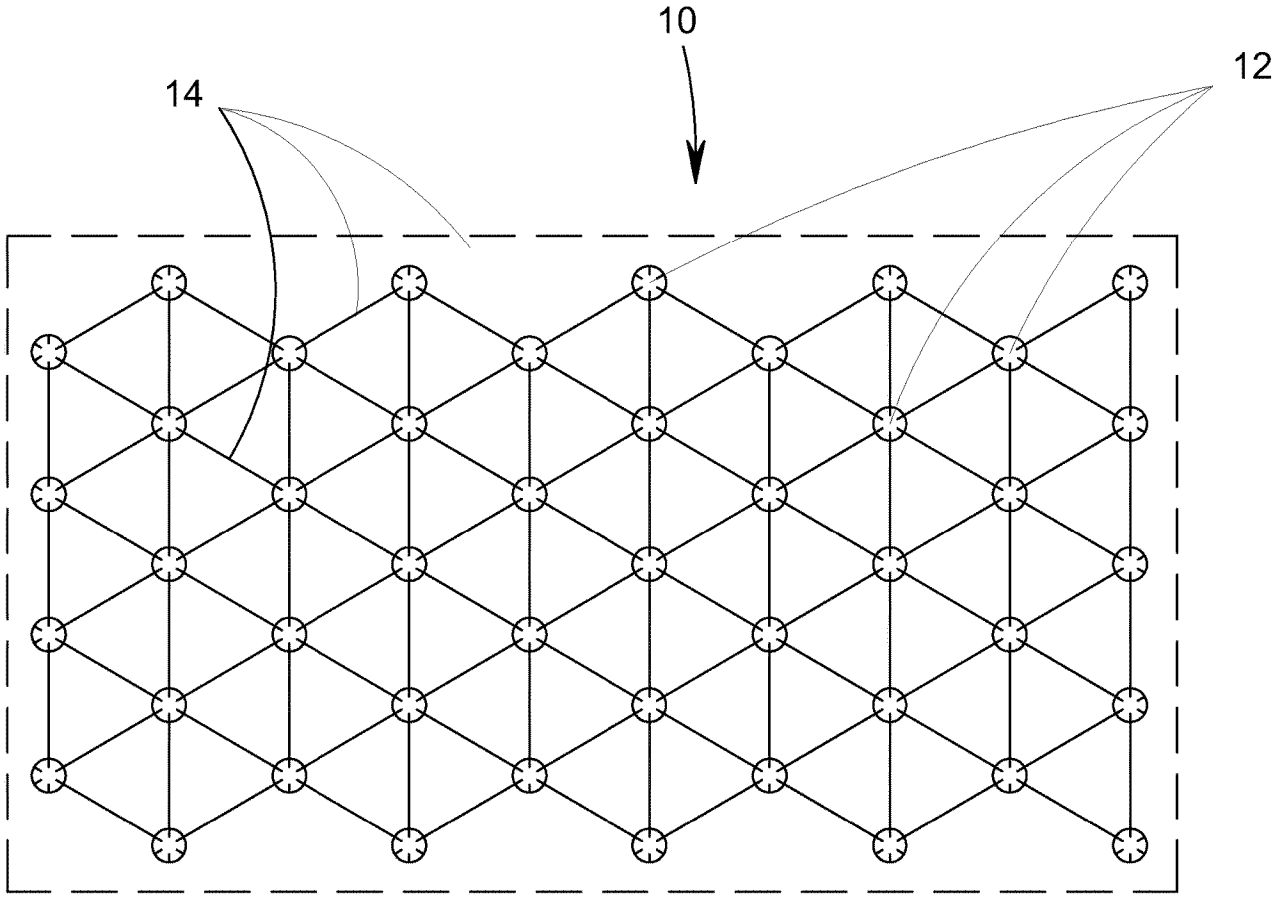
FIG. 14C is an illustrative view of the nodal blocks and the corresponding block connectors in a triangular configuration.

Turning now to FIG. 14A through 14C various lattice configurations of the present invention are seen. In FIG. 14A a hexagonal lattice is made up of the nodal foam blocks 12 and the connectors 14. In FIG. 14B, the lattice created between the nodal foam blocks 12 and the connectors 14 is a square lattice. Lastly, in FIG. 14C the lattice structure created between the nodal blocks 12 and the connectors 14 is comprised of triangles.

Thus the present invention 10 in use is adapted to restore a mattress, cushion, or like portion of a piece of furniture that has developed a sag or indentation through a combination of time and usage by providing a modular support that may be placed underneath the sagging portion. The varying degrees of compressibility provided by the novel nodal foam blocks indicated at 12 in the Figures and the compressible and flexible connector portions indicated at 14 in the Figures allows the user to custom fit the invention to a bed, chair, sofa, or the like that has a sag or sleep indentation therein. The construction of the nodal foam blocks with the varying degrees of compressibility attendant to them allows for small amounts of movement while the invention is in use without sliding. This feature is further enhanced by the adhesive pads located under the blocks 12. These adhesive pads or base layers indicated at 24 in FIGS. 3A, 3C, and 3E may be of a light enough tackiness that the nodal blocks 12 and the connectors 14 may be fixed and then moved as needed or desired.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A modular mattress renewal system, comprising:

a plurality of compressible nodal foam blocks, each of said compressible nodal foam blocks having a plurality of block connector guide apertures with an opening in a sidewall of each of said compressible nodal foam blocks extending from an upper surface to a lower surface thereof and further including nodal foam block adhesive portions, said plurality of compressible nodal foam blocks being a variable number of said compressible nodal foam blocks with the variable number of said compressible nodal foam blocks being adjustable for varying the number of said compressible nodal foam blocks between uses of said modular mattress renewal system; and, a plurality of nodal foam rod-shaped block connectors, each of said nodal foam rod-shaped block connectors having two nodal foam block connector engagement ends for being received in the block connector guide apertures with the opening in the sidewall of each of said compressible nodal foam blocks permitting each of said nodal foam rod-shaped block connectors to vertically slide, and be inserted along a vertical axis of each of said compressible nodal foam blocks, from the upper surface to the lower surface of each of said compressible nodal foam blocks and to protrude from each of said compressible nodal foam blocks, each said nodal foam rod-shaped block connector separating two compressible nodal foam blocks of said plurality of compressible nodal foam blocks in a non-contiguous spatial arrangement with empty spacing between said plurality of compressible nodal foam blocks, wherein said plurality of compressible nodal foam blocks with said plurality of nodal foam rod-shaped connectors are placed underneath a mattress, and not incorporated into the mattress, and fixed in place via said nodal foam block adhesive portions with said nodal foam rod-shaped block connectors being attached via said nodal foam block connector engagement ends for forming a supporting lattice for supporting at least a portion of the mattress by said plurality of compressible nodal foam blocks.

2. The modular mattress renewal system according to claim 1, wherein said plurality of nodal foam rod-shaped block connectors are flexible and compressible.

3. The modular mattress renewal system according to claim 1, wherein each of said compressible nodal foam blocks includes a compressibility gradient extending from a more compressible upper, mattress engaging layer to a less compressible lower, nodal foam block adhesive portion layer for preventing inadvertent movement of said modular mattress renewal system when fixed in place.

4. The modular mattress renewal system according to claim 3, wherein further comprising an additional compressible layer located between said more compressible upper layer and said less compressible lower layer, said additional compressible layer being least compressible and less compressible than said less compressible lower layer.

5. The modular mattress renewal system according to claim 1, wherein said supporting lattice has a rectangular shape.

6. The modular mattress renewal system according to claim 1, wherein said supporting lattice has a hexagonal shape.

7. A modular mattress renewal system, comprising:

a plurality of compressible nodal foam blocks, each of said compressible nodal foam blocks having a plurality of block connector guide apertures with an opening in a sidewall of each of said compressible nodal foam blocks extending from an upper surface to a lower surface thereof, and each of said compressible nodal foam blocks including a compressibility gradient extending from a more compressible upper, mattress engaging layer to a less compressible lower, nodal foam block adhesive portion layer for preventing inadvertent movement of said modular mattress renewal system when fixed in place, said plurality of compressible nodal foam blocks being a variable number of said compressible nodal foam blocks with the variable number of said compressible nodal foam blocks being adjustable for varying the number of said compressible nodal foam blocks between uses of said modular mattress renewal system; and, a plurality of nodal foam block connectors, each of said nodal foam block connectors having two nodal foam block connector engagement ends for being received in the block connector guide apertures with the opening in the sidewall of each of said compressible nodal foam blocks permitting each of said nodal foam block connectors to vertically slide, and be inserted along a vertical axis of each of said compressible nodal foam blocks, from the upper surface to the lower surface of each of said compressible nodal foam blocks and to protrude from each of said compressible nodal foam blocks, wherein said plurality of compressible nodal foam blocks, positioned in a non-contiguous spatial arrangement with empty spacing between said plurality of compressible nodal foam blocks, are placed underneath a mattress, and not incorporated into the mattress, and are fixed in place via said nodal foam block adhesive portion layer with said nodal foam block connectors being attached via said nodal foam block connector engagement ends for forming a supporting lattice for supporting at least a portion of the mattress by said plurality of compressible nodal foam blocks.

8. The modular mattress renewal system according to claim 7, wherein further comprising an additional compressible layer located between said more compressible upper layer and said less compressible lower layer, said additional compressible layer being least compressible and less compressible than said less compressible lower layer.

9. The modular mattress renewal system according to claim 7, wherein said supporting lattice has a rectangular shape.

10. The modular mattress renewal system according to claim 7, wherein said supporting lattice has a hexagonal shape.

11. A modular mattress renewal system, comprising:

a plurality of compressible nodal foam blocks, each of said compressible nodal foam blocks having a plurality of block connector guide apertures with an opening in a sidewall of each of said compressible nodal foam blocks extending from an upper surface to a lower surface thereof and further including nodal foam block adhesive portions; and, a plurality of nodal foam rod-shaped block connectors, each of said nodal foam rod-shaped block connectors having two nodal foam block connector engagement ends for being received in the block connector guide apertures at either the upper surface or the lower surface of each of said compressible nodal foam blocks with the opening in the sidewall of each of said compressible nodal foam blocks permitting each of said nodal foam rod-shaped block connectors to vertically slide, and be inserted along a vertical axis of each of said compressible nodal foam blocks, from the upper surface to the lower surface of each of said compressible nodal foam blocks and to protrude from each of said compressible nodal foam blocks, each said nodal foam rod-shaped block connector separating two compressible nodal foam blocks of said plurality of compressible nodal foam blocks in a non-contiguous spatial arrangement with empty spacing between said plurality of compressible nodal foam blocks, wherein said plurality of compressible nodal foam blocks with said plurality of nodal foam rod-shaped connectors are placed underneath a mattress, and not incorporated into the mattress, and fixed in place via said nodal foam block adhesive portions with said nodal foam rod-shaped block connectors being attached via said nodal foam block connector engagement ends for forming a supporting lattice for supporting at least a portion of the mattress by said plurality of compressible nodal foam blocks.

12. The modular mattress renewal system according to claim 11, wherein said plurality of nodal foam rod-shaped block connectors are flexible and compressible.

13. The modular mattress renewal system according to claim 11, wherein each of said compressible nodal foam blocks includes a compressibility gradient extending from a more compressible upper, mattress engaging layer to a less compressible lower, nodal foam block adhesive portion layer for preventing inadvertent movement of said modular mattress renewal system when fixed in place.

14. The modular mattress renewal system according to claim 13, wherein further comprising an additional compressible layer located between said more compressible upper layer and said less compressible lower layer, said additional compressible layer being least compressible and less compressible than said less compressible lower layer.

15. The modular mattress renewal system according to claim 11, wherein said supporting lattice has a rectangular shape.

16. The modular mattress renewal system according to claim 11, wherein said supporting lattice has a hexagonal shape.

17. A modular mattress renewal system, comprising:

a plurality of compressible nodal foam blocks, each of said compressible nodal foam blocks having a plurality of block connector guide apertures with an opening in a sidewall of each of said compressible nodal foam blocks extending from an upper surface to a lower surface thereof and each of said compressible nodal foam blocks including a compressibility gradient extending from a more compressible upper, mattress engaging layer to a less compressible lower, nodal foam block adhesive portion layer for preventing inadvertent movement of said modular mattress renewal system when fixed in place; and, a plurality of nodal foam block connectors, each of said nodal foam block connectors having two nodal foam block connector engagement ends for being received in the block connector guide apertures at either the upper surface or the lower surface of each of said compressible nodal foam blocks with the opening in the sidewall of each of said compressible nodal foam blocks permitting each of said nodal foam block connectors to vertically slide, and be inserted along a vertical axis of each of said compressible nodal foam blocks, from the upper surface to the lower surface of each of said compressible nodal foam blocks and to protrude from each of said compressible nodal foam blocks, wherein said plurality of compressible nodal foam blocks, positioned in a non-contiguous spatial arrangement with empty spacing between said plurality of compressible nodal foam blocks, are placed underneath a mattress, and not incorporated into the mattress, and are fixed in place via said nodal foam block adhesive portion layer with said nodal foam block connectors being attached via said nodal foam block connector engagement ends for forming a supporting lattice for supporting at least a portion of the mattress by said plurality of compressible nodal foam blocks.

18. The modular mattress renewal system according to claim 17, wherein further comprising an additional compressible layer located between said more compressible upper layer and said less compressible lower layer, said additional compressible layer being least compressible and less compressible than said less compressible lower layer.

19. The modular mattress renewal system according to claim 17, wherein said supporting lattice has a rectangular shape.

20. The modular mattress renewal system according to claim 17, wherein said supporting lattice has a hexagonal shape.

* * * * *